US008034751B2

(12) United States Patent
Singh et al.

(10) Patent No.: US 8,034,751 B2
(45) Date of Patent: Oct. 11, 2011

(54) COMPOSITION OF HYDRAULIC FLUID AND PROCESS FOR THE PREPARATION THEREOF

(75) Inventors: Arun Kumar Singh, Uttranchal (IN); Naval Kishore Pandey, Uttranchal (IN); Ashok Kumar Gupta, Uttranchal (IN)

(73) Assignee: Council of Scientific & Industrial Research (IN)

( * ) Notice: Subject to any disclaimer, the term of this patent is extended or adjusted under 35 U.S.C. 154(b) by 1111 days.

(21) Appl. No.: 11/392,994

(22) Filed: Mar. 29, 2006

(65) Prior Publication Data

US 2007/0060486 A1 Mar. 15, 2007

(30) Foreign Application Priority Data

Dec. 9, 2005 (IN) ..... 3332/DEL/2005

(51) Int. Cl.
*C10M 169/04* (2006.01)
*C10M 175/00* (2006.01)

(52) U.S. Cl. ..... 508/110; 508/577

(58) Field of Classification Search ..... 508/577, 508/110

See application file for complete search history.

(56) References Cited

U.S. PATENT DOCUMENTS

| | | | | | |
|---|---|---|---|---|---|
| 2,595,557 | A * | 5/1952 | Worth et al. | ..... | 508/313 |
| 4,783,274 | A | 11/1988 | Jokinen et al. | | |
| 5,171,462 | A * | 12/1992 | DeRosa et al. | ..... | 508/281 |
| 5,360,565 | A | 11/1994 | Junga | | |
| 5,366,658 | A | 11/1994 | Hoppe et al. | | |
| 5,498,809 | A * | 3/1996 | Emert et al. | ..... | 585/13 |
| 5,538,654 | A | 7/1996 | Lawate et al. | | |
| 5,580,482 | A | 12/1996 | Chasan et al. | | |
| 5,652,201 | A * | 7/1997 | Papay et al. | ..... | 508/228 |
| 5,888,947 | A | 3/1999 | Lambert et al. | | |
| 6,300,292 | B2 | 10/2001 | Konishi et al. | | |
| 6,436,883 | B1 | 8/2002 | Nieh | | |
| 7,339,088 | B1 * | 3/2008 | O'Brien et al. | ..... | 585/804 |
| 2002/0010103 | A1 * | 1/2002 | Takayama et al. | ..... | 508/433 |

* cited by examiner

*Primary Examiner* — Jim Goloboy
(74) *Attorney, Agent, or Firm* — St. Onge Steward Johnston & Reens LLC

(57) ABSTRACT

The present invention provides a composition of hydraulic fluid that mainly contains alkyl benzenes. In addition to alkyl benzenes, the composition also contains an antioxidant, an antifoaming agent, a pour point dispersant, a corrosion inhibitor and a detergent-dispersant additive, an extreme pressure additive, a lubrication additives, comprising of the following steps (I) removing of insoluble matter from the base stock, (II) tailoring the base stock by vacuum distillation and blending, (IV) removing the oxidized matters by adsorption, (V) addition of performance additives and homogenizing the mixture. The product of this invention has utility as an general purpose hydraulic fluid.

11 Claims, No Drawings

COMPOSITION OF HYDRAULIC FLUID AND PROCESS FOR THE PREPARATION THEREOF

FIELD OF THE INVENTION

The present invention relates to a composition of hydraulic fluid and process for the preparation thereof. This invention particularly relates to composition of hydraulic fluid that mainly contains alkyl benzenes. In addition to alkyl benzenes, the composition also contains an antioxidant, an extreme pressure additive, an antifoaming agent, a pour point depressant, a corrosion inhibitor, a detergent-dispersant additive and a lubricity additive, according to which it produce lower amount of pollution. The product of this invention has utility as a general purpose hydraulic fluid in vacuum pumps and stationary equipment.

BACKGROUND OF THE INVENTION

Hydraulic oil is an industrial lubricant used in many applications, from gear pumps to axial piston pumps to heavy-duty farm and industrial equipment. All hydraulic oils should prevent components from excessive wear and maintenance costs even under extreme temperatures. The deterioration can result from a variety of factors. Rust is one common problem that plagues small parts in engines, transmissions, and hydraulics systems. This problem often arises from the presence of excess water vapor in the system. Oxidation and foam build up is other problems that build up over time and affect the performance of hydraulics systems. For optimal functioning, a hydraulic fluid must be relatively incompressible and must flow readily. In addition, it should provided adequate lubricity for moving parts, stability under anticipated conditions of use, compatibility with materials used to construct the hydraulic system, and the fluids should have the ability to protect system components against chemical reaction with materials which may enter the system. Finally, they should have a minimal impact on the environment.

The hydraulic oil serving as the power transmission medium in a hydraulic system. The most commonly used fluids are petroleum oils, synthetic lubricants, oil-water emulsion, and water-glycol mixtures. The principal requirements of a hydraulic fluid are proper viscosity high viscosity index, anti-wear protection, good oxidation stability, adequate pour point, good de-emulsibility, rust inhibition, resistance to foaming, and compatibility with seal materials. Anti-wear oils are frequently used in compact, high-pressure, and high-capacity pumps that require extra lubrication protection. Certain synthetic lubricants and water-containing fluids are used where fire resistance is needed. Synthetic lubricants also are used in extreme-temperature conditions.

Only slight change in volume during usage, adequate oxidation resistance, for some cases of application adequate de-emulsification capacity, adequate shear stability, if polymer viscosity index improvers are used viscosity-temperature behavior, so that oil changes due to summer and winter operation become redundant, adequately low viscosity-temperature behavior, and minimal characteristics changes of standard elastomers are desirable. Now, pollution and environmental aspects of various products have become important issues. The uncontrolled loss of lubricants can endanger environment by coming into contact directly with the nature (organisms, soil, live water etc.) as a consequence of leakage, throw off, emissions, spillage or careless disposal. Great efforts have been made during the last 25 years by several countries and major industries to develop and find more and more environment friendly—nontoxic products and technologies which have a less negative impact on our precious environment.

In the prior art for producing hydraulic oils, generally, mineral oils or mineral oil with synthetic fluids or complex ester of fatty acids were used. The focus has been on the use of such oil base to enhance the performance.

Reference may be made to U.S. Pat. No. 5,360,565 Junga, Nov. 1, 1994 Petro-Lube, Inc. (Whitemore Lake, Mich.) *Hydraulic oil*. An improved anti-wear, high-pressure hydraulic oil which contains essentially no zinc or phosphorous is described. The hydraulic oil protects against corrosion and oxidation as well as provides anti-wear, anti-weld, and demulsibility properties. This improved hydraulic oil contains (1) petroleum hydrocarbon oil; (2) esters of dibasic and monobasic acids; (3) butylated phenol; (4) phenol; (5) sulfurized fatty oil; (6) fatty acid; and (7) sulfur scavenger. This hydraulic oil has a reduced tendency towards sludge formation and has, therefore, an increased lifetime. (mineral oils was used)

Reference may be made to U.S. Pat. No. 6,300,292 Konishi, et al. Oct. 9, 2001 Nippon Mitsubishi Oil Corporation (Tokyo, JP) *Hydraulic oil composition*. A hydraulic oil composition which is excellent in oxidative stability, lubricating properties and biodegradability; comprising vegetable oil as base oil, and one phenol antioxidant, an amine antioxidant and a zinc dithiophosphate antioxidant. (edible vegetable oils are used)

Reference may be made to U.S. Pat. No. 6,436,883, Nieh, Aug. 20, 2002, Huntsman Petrochemical Corporation (Austin, Tex.) *Hydraulic and gear lubricants*. Provided herein are functional fluid compositions useful in hydraulic fluid and gear oil formulations. The formulations according to the invention include a predominant amount of at least one polyoxyalkylene glycol derived from the addition polymerization of an alcohol in the presence of an alkylene oxide mixture, which contains a substantial amount of ethylene oxide. Fluids according to the invention exhibit suitable lubricity and stability characteristics and are generally water soluble to a degree sufficient to preclude formation of a sheen on the surface of a body of water into which a fluid according to the invention is brought into contact. (polyethylene glycol was used)

Reference may be made to U.S. Pat. No. 5,366,658, Hoppe, et al., Nov. 22, 1994, Huls Aktiengesellschaft (Marl, Del.) *Use of polymethylalkanes as biodegradable base oils in lubricants and functional fluids* The invention relates to the use of polymethylalkanes having terminal methyl groups and methylene and ethylidene groups in which the total number of C atoms n+2 m+2 is 20 to 100 and the ratio of the methyl and methylene groups to the ethylidene groups is 3 to 20:1 and the ethylidene groups are always separated by at least one methylene group, as biodegradable base oils for lubricants and functional fluids. Suitable polymethylalkanes are obtained by oligomerization of .alpha.,.omega.-diolefins, for example in particular according to P 41 19 332.6, or by pyrolysis of ethene/propane copolymers and subsequent hydrogenation in each case. The polymethylalkanes can be combined with conventional additives and other degradable or non-degradable base oils. (polymethyl alkanes was used)

Reference may be made to U.S. Pat. No. 4,783,274 (Jokinen et al., Nov. 8, 1988) Concerned with an anhydrous oily lubricant, which; is based on vegetable oils, which is substituted for mineral lubricant oils, and which, as its main component, contains triglycerides that are esters of saturated and/or unsaturated straight-chained C.sub.10 to C.sub.22 fatty acids and glycerol. The lubricant is characterized in that it contains at least 70 percent by weight of a triglyceride whose iodine number is at least 50 and no more than 125 and whose viscosity index is at least 190. As its basic component, instead of or along with the said triglyceride, the lubricant oil may also contain a polymer prepared by hot-polymerization out of the said triglyceride or out of a corresponding triglyceride. As additives, the lubricant oil may contain solvents, fatty acid derivatives, in particular their metal salts, organic or inorganic, natural or synthetic polymers, and customary additives for lubricants. (edible vegetable oils are used)

Reference may be made to U.S. Pat. No. 5,538,654 (Lawate et al., Jul. 23, 1996) Describes a food grade lubricant composition, which is useful as hydraulic oil, gear oil, and compressor, oil for equipment in the food service industry. This composition comprises (A) a major amount of a genetically modified vegetable oil and (B) a minor amount of a performance additive. In other embodiments the composition contains either (C) a phosphorus compound or (D) a non-genetically modified vegetable oil. (edible vegetable oils are used)

Reference may be made to U.S. Pat. No. 5,580,482 (Chassan et al., Dec. 3, 1996) A lubricant composition stabilized against the deleterious effects of heat and oxygen said composition comprising a triglyceride oil or an oil which is an ester wherein unsaturation is present in either the alcohol moiety or the acid moiety and an effective stabilizing amount of either an N,N-disubstituted aminomethyl-1,2,4-triazole or an N,N-disubstituted aminomethylbenzotriazole and a higher alkyl substituted amide of dodecylene succinic acid. (edible vegetable oil with an additive was used)

Reference may be made to U.S. Pat. No. 5,888,947 (Lambert et al., Mar. 30, 1999) A composition that has three main components: a base oil, an oil source containing hydroxy fatty acids and an oil source containing vegetable or animal waxes. The base oil used in the reference needs to consist of primarily triglycerols (triglycerides) and mono- and diglycerols (glycerides) and free fatty acids. The composition further consists of vegetable oils where the glycerols contain hydroxy fatty acids, preferably making up 5% to 20% of the oil. A third major component is waxes composing 5% to 10% of the oil additives by volume. Additional synthetic mimics or natural products derived from animal or vegetable compounds may be added up to 5% of the compositional volume. (glycol fatty esters and fats are used)

A patent filled by the inventors of the present invention disclosed the use of Heavy Alkyl Benzene alkaline earth metal sulfonates that are used as detergent-dispersant-anti rust additive in various types of lubricants (Patent application IPA number 1306/DEL1998 & 1307/DEL/1998 by A. K. Singh et al assigned to CSIR). The alkyl benzenes are mono, di and poly substituted alkyl aromatics having one benzene or toluene aromatic ring and straight or branched paraffinic chains having carbon atoms 1 to 15 preferably 10 to 15, preferably mono and di alkyl benzene. Alkyl benzenes are produced as by-products during the preparation of, (1) linear alkyl benzene (LAB) in detergent industry, (2) heavy aromatic produced in catalytic reformer, and (3) naphtha or gas steam cracker liquid product. Alkyl benzene consists of substituted benzenes and no poly-aromatics/condensed ring or olefinic compounds are present in the alkyl benzenes. It can be used as an alternate to mineral base stock of lubricants. It will reduce the hazard potential of the lubricants. It will provide required properties such as good hydraulic properties, lubricity, load carrying, stability, anti-corrosion properties and more eco-friendliness.

There is a need for developing new hydraulic fluid composition, which is free from harmful, polynuclear aromatic hydrocarbons generally found in mineral oil and produce less pollution. These objectives must be met, while simultaneously satisfying stringent performance standards, e.g., good lubricity, load carrying, stability and anti-corrosion.

OBJECTIVES OF THE INVENTION

The main object of the present invention is to provide a composition of hydraulic fluid and process for the preparation thereof, which obviates the drawbacks as detailed above. Another object of the present invention is to provide a composition and process for hydraulic fluid from alternate source based on alkyl benzenes obtained from various petrochemical or refinery waste streams such as heavy alkylates from LAB plants, higher aromatic from catalytic reformers or steam cracking plants.

Yet another object of the present invention is to avoid the use polynuclear aromatic hydrocarbons, a component of mineral oil and reducing pollution potential of the hydraulic fluid formulation.

Still another object of the present invention is to provide excellent miscibility of formulated hydraulic fluid with mineral, vegetable and synthetic oil in all proportions.

SUMMARY OF THE INVENTION

Accordingly the present invention provides a composition of hydraulic fluid comprising

| | | |
|---|---|---|
| (i) | base stoke of tailored heavy alkyl benzene having carbon atom mainly C18 to C22 in the range of | 98.0-99.8 wt %, |
| (ii) | anti-oxidant in the range of | 0.006-0.05% by weight |
| (iii) | extreme pressure additive in the range of | 0.005-0.05% by weight, |
| (iv) | detergent-dispersant in the range of | 0.05-0.15% by weight, |
| (v) | anti-foaming agent in the range of | 0.01 to 1.0% by weight, |
| (vi) | pour point dispersant in the range of | 0.01 to 1.0% by weight, |
| (vii) | corrosion inhibitor in the range of | 0.10-0.03% by weight |
| (viii) | lubricity additive in the range of | 0.005-0.05% by weight. |

In an embodiment of the present invention the hydraulic fluid obtained has the following characteristics:

(i) Kinetic viscosity at 40° C. is in the range of 20-30 cst,
(ii) Viscosity index 100-110,
(iii) Oxidation stability Pass (IP 48/97)
(iv) Rotatory bomb oxidation test (ROBOT) at 95° C. is 290-310 min.,
(v) Flash point 145-165° C.,
(vi) Pour point (–)30-40° C.,
(vii) Lubricity-Friction.Coeff. about 0.14-0.17 μm,
(viii) Wear Scarp Dia (WSD) about 0.43-0.46 mm,
(ix) Copper Strip corrosion test 1A,
(x) Foam test ASTM D130 Pass,
(xi) Total acid no. <0.001 mgKOH
(xii) Biodegradability 40-50%.

In an embodiment the heavy alkyl benzene used is mono, di and poly substituted alkyl aromatics having one benzene aromatic ring and straight or branched paraffinic chains having carbon atoms 18 to 22.

In yet another embodiment the heavy alkyl benzene fractions (C18-22) used is obtained from mono and di alkyl benzenes produced during the production of linear alkyl benzene (LAB) in detergent industry, heavy alkyl aromatics produced in catalytic reformer, and naphtha or gas steam cracker liquid product or mixture thereof.

In yet another embodiment the anti-oxidant used is selected from the group consisting of 2,4,6-tri-tert-butylphenol, 2,6-di-tert-butyl-4-n-butylphenol, 2,6-di-t-butyl-4-methylphenol or n-octadecyl 3-(3,5-di-t-butyl-4-hydroxy phenyl) propionate, penta erythrityl tetrakis[3-(3,5-di-t-butyl-4-hydroxyphenyl) propionate], di-n-octadecyl(3,5-di-t-butyl-4-hydroxybenzyl)phosphonate, 2,4,6-tris(3,5-di-t-butyl-4-hydroxybenzyl) mesitylene, tris(3,5-di-t-butyl-4-hydroxybenzyl) isocyanurate or hindered piperidine carboxylic acids, acylated derivatives of 2,6-dihydroxy-9-azabicyclo[3.3.1]nonane or bicyclic hindered amines or diphenylamines or dinaphthylamines, phenylnaphthyl amines, N,N'-diphenylphenylenediamine or p-octyldiphenylamine, p,p-dioctyl diphenylamine, N-phenyl-1-naphthylamine, N-phenyl-2-naphthylamine, N-(p-dodecyl)phenyl-2-naphthylamine, di-1-naphthylamine, di-2naphthylamine, N-alkyl phenothiazines, imino(bisbenzyl), 6-(t-butyl)phenol, 2,6-di-(t-butyl)phenol, 4-methyl-2,6-di-(t-butyl) phenol, 4,4'-methylenebis(−2,6-di-(t-butyl)phenol), Methyl hydroxy hydro cinnamide, phenothiazines derivatives, alkylated 5-amino tetrazole, di-ter.Butyl p-amino phenol and a mixture thereof.

In yet another embodiment the extreme pressure additive used is selected from the group consisting of sulfirized neem oil, sulfirized mahua oil, dibenzyl disulphide, suphurized pentadecyl phenol, thiophosphoro luryl oleate, molybdenum salt of thiophosphoro luryl oleate, zinc dialkyl dithio phosphate, dibenzyl diselenate, selenophosphoro luryl oleate, selenophosphoro pentadecyl phenol, molybdenum thiophosphoro pentadecyl phenol and a mixture thereof.

In yet another embodiment the lubricity additive used is selected from octyl phosphates, methyl hydroxy hydro cinnamide and a mixture thereof.

In yet another embodiment the detergent-dispersant used is selected from the group consisting of calcium alkyl benzene sulfonate, sodium alkyl benzene sulfonate, propylene teramer succinimide of pentaethylene hexamine, octyl phosphonates and a mixture thereof.

In yet another embodiment the anti-foaming agent used is selected from the group consisting of silicone oil, polyvinyl alcohol, polyethers and a mixture thereof.

In yet another embodiment the pour point dispersant used is selected from the group consisting of diethylhexyl adipate, polymethacrylate, polyvinylacrylate and a mixture thereof.

In yet another embodiment the corrosion inhibitor used is selected from the group consisting of octyl 1H benzotriazole, ditertiary butylated 1H-Benzotriazole, propyl gallate, polyoxyalkylene polyols, octadecyl amines, nonyl phenol ethoxylates, calcium phenolates of hydrogenated pentadecyl phenol, magnesium alkyl benzene sulfonates and a mixture thereof.

The present invention further provides a process for the preparation of composition of hydraulic fluid, which comprises fractionating heavy alkylate fractions of linear alkyl benzene (LAB) or crackers, at a temperature in the range of 300-400° C., under vacuum distillation to obtain desired fractions of alkyl benzene having carbon atom C18 to C22 and viscosity in the range of 20-30 cst at about 40° C., removing the oxidized product from the above alkyl fractions by known methods to obtain a base stock, mixing 98-99.8 wt % of the above said base stock, at least one anti-oxidant in the range of 0.005-0.05 W %, at least one extreme pressure additive in the range of 0.005-0.05 W %, at least one detergent-dispersant in the range of 0.05-0.15 W %, at least one anti-foaming agent in the range of 0.01 to 1.0 W %, at least one pour point dispersant in the range of 0.01 to 1.0 W %, at least one corrosion inhibitor in the range of 0.10-0.03 W %, and at least one lubricity additive in the range of 0.005-0.05 W %, under stirring, at a temperature in the range of 50-90° C. to obtain the desired lubricating oil composition.

In yet another embodiment the heavy alkyl benzene used is mono, di and poly substituted alkyl aromatics having one benzene aromatic ring and straight or branched paraffinic chains having carbon atoms mainly C18 to C22

In yet another embodiment the heavy alkyl benzene fractions (C18-22) used is obtained from mono and di alkyl benzenes produced during the production of linear alkyl benzene (LAB) in detergent industry, heavy alkyl aromatics produced in catalytic reformer, and naphtha or gas steam cracker liquid product or mixture thereof.

In yet another embodiment the anti-oxidant used is selected from the group consisting of 2,4,6-tri-tert-butylphenol, 2,6-di-tert-butyl-4-n-butylphenol, 2,6-di-t-butyl-4-methylphenol or n-octadecyl 3-(3,5-di-t-butyl-4-hydroxy phenyl)propionate, penta erythrityl tetrakis[3-(3,5-di-t-butyl-4-hydroxyphenyl)propionate], di-n-octadecyl (3,5-di-t-butyl-4-hydroxybenzyl) phosphonate, 2,4,6-tris(3,5-di-t-butyl-4-hydroxybenzyl)mesitylene, tris(3,5-di-t-butyl-4-hydroxybenzyl)isocyanurate or hindered piperidine carboxylic acids, acylated derivatives of 2,6-dihydroxy-9-azabicyclo[3.3.1]nonane or bicyclic hindered amines or diphenylamines or dinaphthylamines, phenylnaphthyl amines, N,N'-diphenylphenylenediamine or p-octyldiphenylamine, p,p-dioctyl diphenylamine, N-phenyl-1-naphthylamine, N-phenyl-2-naphthylamine, N-(p-dodecyl)phenyl-2-naphthylamine, di-1-naphthylamine, di-2naphthylamine, N-alkyl phenothiazines, imino(bisbenzyl), 6-(t-butyl)phenol, 2,6-di-(t-butyl)phenol, 4-methyl-2,6-di-(t-butyl)phenol, 4,4'-methylenebis(−2,6-di-(t-butyl)phenol), Methyl hydroxy hydro cinnamide, phenothiazines derivatives, alkylated 5-amino tetrazole, di-ter.Butyl p-amino phenol and a mixture thereof.

In yet another embodiment the extreme pressure additive used is selected from the group consisting of sulfurized neem oil, sulfurized mahua oil, dibenzyl disulphide, suphurized pentadecyl phenol, thiophosphoro luryl oleate, molybdenum salt of thiophosphoro luryl oleate, zinc dialkyl dithio phosphate, dibenzyl diselenate, selenophosphoro luryl oleate, selenophosphoro pentadecyl phenol, molybdenum thiophosphoro pentadecyl phenol and a mixture thereof.

In yet another embodiment the lubricity additive used is selected from octyl phosphates, methyl hydroxy hydro cinnamide and a mixture thereof.

In yet another embodiment the detergent-dispersant used is selected from the group consisting of calcium alkyl benzene sulfonate, sodium alkyl benzene sulfonate, propylene teramer succinimide of pentaethylene hexamine, octyl phosphonates and a mixture thereof.

In yet another embodiment the anti-foaming agent used is selected from the group consisting of silicone oil, polyvinyl alcohol, polyethers and a mixture thereof.

In yet another embodiment the pour point dispersant used is selected from the group consisting of diethylhexyl adipate, polymethacrylate, polyvinylacrylate and a mixture thereof.

In yet another embodiment the corrosion inhibitor used is selected from the group consisting of octyl 1H benzotriazole, ditertiary butylated 1H-Benzotriazole, propyl gallate, polyoxyalkylene polyols, octadecyl amines, nonyl phenol ethoxylates, calcium phenolates of hydrogenated pentadecyl phenol, magnesium alkyl benzene sulfonates and a mixture thereof.

In yet another embodiment the lubricating oil composition obtained has the following characteristics:

| | | |
|---|---|---|
| (i) | base stoke of tailored heavy alkyl benzene having carbon atom mainly C18 to C22 in the range of | 98.0-99.8 wt %, |
| (ii) | anti-oxidant in the range of | 0.006-0.05% by weight |
| (iii) | extreme pressure additive in the range of | 0.005-0.05% by weight, |
| (iv) | detergent-dispersant in the range of | 0.05-0.15% by weight, |
| (v) | anti-foaming agent in the range of | 0.01 to 1.0% by weight, |
| (vi) | pour point dispersant in the range of | 0.01 to 1.0% by weight, |
| (vii) | corrosion inhibitor in the range of | 0.10-0.03% by weight |
| (viii) | lubricity additive in the range of | 0.005-0.05% by weight. |

The composition are significantly non-toxic having no polynuclear aromatic, biodegradable in the range of 20 to 60%, Flash point 150 to 200° C., pour point less than (−)10° C., Kinematic viscosity at 40° C. 20 to 30 cst, Viscosity Index 90 to 120, Oxidation stability (RoBOT) 200 to 400 min, TAN below 0.01 mgKOH, copper corrosion below 1 and able to replace the traditional mineral lube oils. The main advantages are, it reduces use of petroleum, low cost than synthetic oil, product is more biodegradable and eco-friendly than petroleum lubes, safe to use due to higher flash point and non-toxicity.

Comparison of Properties of Hydraulic Fluid

| SN. | Properties | U.S. Pat. No. 5360565 claim | Exxon Exxtrans 10 W In Market | Our claim application | Remarks |
|---|---|---|---|---|---|
| 1 | Kinetic Viscosity at 40° C., centistokes | 46 | 42 | 28 | near to 10 W |
| 2 | Flash Point, ° C. | 204 | 202 | 160 | Slight inferior but more than requirement of 140° C. |
| 3 | Pour point, ° C. | −12 | −33 | −38 | Better |
| 4 | Viscosity Index | 95 | 96 | 105 | Better |
| 5 | Performance tests | Pass | Pass | Pass | |
| 6 | Biodegradability % | 20-40 | 20-40 | 35-45 | Better |
| 7 | Polynuclear Aromatics presence | yes | yes | No | Better |

The following examples are given by the way of illustration and therefore should not be construed to limit the scope of the invention

EXAMPLE 1

TAILORING OF HEAVY ALKYLATE: commercial heavy alkylates, a heavy waste fraction of detergent class linear alkyl benzene (LAB), was fractionated by vacuum distillation. The heavier cut having 70 weight percent of total alkylate was taken for base-stock preparation. The typical properties of the alkylate are:

| | |
|---|---|
| Density at 15° C., gm/ml | 0.8758 |
| Kinetic viscosity at 40° C., cst | 26.75 |
| Viscosity index | 95 |
| Refractive index at 20° C. | 1.48426 |
| Pour point | (−)37° C. |
| Molecular weight | 433 ± 5 |
| RoBOT oxidation stability at 95° C. | 200 minuts |
| Distillation range | 300 to 400° C. |
| Poly-aromatics or olefinic compounds | Negligible |

EXAMPLE 2

TAILORING OF ALKYLATE: commercial alkylates, a waste alkyl benzene from cracker unit, was fractionated by vacuum distillation. The heavier cut having 65 weight percent of total alkylate was taken for base-stock preparation. The typical properties of the alkylate are

| | |
|---|---|
| Density at 15° C., gm/ml | 0.8703 |
| Kinetic viscosity at 40° C., cst | 30.11 |
| Viscosity index | 98 |
| Refractive index at 20° C. | 1.48106 |
| Pour point | (−)32° C. |
| Molecular weight | 428 ± 5 |
| RoBOT oxidation stability at 95° C. | 190 minuts |
| Distillation range | 300 to 410° C. |
| Poly-aromatics or olefinic compounds | Negligible |

EXAMPLE 3

Preparation of Base Stock

Tailored heavy alkylate was passed through silica gel column to remove oxidized product or treated with absorbent clay such as fuller's earth by mixing and thoroughly stirred for 50 minutes at 80° C. and filtering it through G-4 sintered glass funnel. The typical physico-chemical characteristics of the heavy alkylate are:

| | |
|---|---|
| Kinetic viscosity at 100° C., cst | 4.705 |
| Kinetic viscosity at 40° C., cst | 26.62 |
| Viscosity index | 104 |
| Oxidation Stability, IP 48/97 | Pass - increase in viscosity 0.88% |
| Pour point | (−)38° C. |
| RoBOT test 95° C. | 250 minutes |
| Flash point | 152° C. |
| Acid number, mg KOH | 0.005 |
| Poly-aromatics or olefinic compounds | Negligible |

EXAMPLE 4

Preparation of Base Stock

Tailored alkylate from cracker unit was passed through silica gel column to remove oxidized product or treated with absorbent clay such as fuller's earth by mixing and thoroughly stirred for 50 minutes at 80° C. and filtering it through G-4 sintered glass funnel. The typical physico-chemical characteristics of the base oil was,

| | |
|---|---|
| Kinetic viscosity at 100° C., cst | 5.11 |
| Kinetic viscosity at 40° C., cst | 30.03 |
| Viscosity index | 109 |
| Oxidation Stability, IP 48/97 | Pass - increase in viscosity 0.89% |
| Pour point | (−)36° C. |
| RoBOT test 95° C. | 210 minutes |
| Flash point | 153° C. |
| Acid number, mg KOH | 0.005 |
| Poly-aromatics or olefinic compounds | Negligible |

EXAMPLE 5

Preparation of Base Stock

Tailored alkylate from cracker unit and LAB plant were passed through silica gel column to remove oxidized product. 50 wt % of heavy alkylate and 50 wt % of alkylate from cracker unit were mixed and thoroughly stirred for 50 minutes at 60° C. The typical physico-chemical characteristics of the blended base oil was,

| | |
|---|---|
| Kinetic viscosity at 100° C., cst | 5.12 |
| Kinetic viscosity at 40° C., cst | 30.83 |
| Viscosity index | 104 |
| Oxidation Stability, IP 48/97 | Pass - increase in viscosity 0.9% |
| Pour point | (−)38° C. |
| RoBOT test 95° C. | 220 minutes |
| Flash point | 150° C. |
| Acid number, mg KOH | 0.005 |
| Poly-aromatics or olefinic compounds | Negligible |

EXAMPLE 6

Preparation of Lube Oil from Base Stock

The base stock was blended with additive octyl 5amino tetrazole as a high temperature anti-oxidant in 200 ppm, dibezyl disulphide as EP additive in 200 ppm, sulfurized neem oil as EP additives in 200 ppm, Methyl Hydroxy Hydro Cinnamate as low temperature antioxidant-lubricity additives in 80 ppm, pentaethylene hexamine dodecyl succinimide as detergent-dispersant in 100 ppm, Silicone polymer oil as antifoaming agent-pour point depressant and calcium HAB sulfonate as corrosion inhibitors having base number 500 in 150 ppm concentration and the ethylhexyl ester of fatty acid of rice bran oil as a lubricity enhancer in 5% of base oil. The doping was done at 60° C. with stirring for 2 hours.

EXAMPLE 7

Preparation of Lube Oil from Base Stock

The base stock was blended with additive p-p-dioctyl diphenyl amine as a high temperature anti-oxidant in 100 ppm, dibezyl diselenide as EP additive in 200 ppm, sulfirized ricebran oil as lubricity additives in 200 ppm, zinc dialkyl dithio phosphate as low temperature antioxidant-lubricity additives in 50 ppm, octyl phosphonate as detergent-dispersant in 100 ppm, poly vinyl acrylate as antifoaming agent-pour point depressant and alkyl benzotriazole as corrosion inhibitors having base number 500 in 50 ppm concentration and the ethylhexyl ester of hydrogenated fatty acid of neem oil as a lubricity enhancer in 5% of base oil. The doping was done at 60° C. with stirring for 2 hours.

EXAMPLE 8

Preparation of Lube Oil from Base Stock

The base stock was blended with additive di-t-butyl 4-methyl phenol as a high temperature anti-oxidant in 100 ppm, Molybdenul thiophosphoro pentadecyl phenol as EP additive in 200 ppm, sulfurized hydrogenated karanja oil as co-EP additives in 200 ppm, Methyl Hydroxy Hydro Cinnamate as low temperature antioxidant-lubricity additives in 150 ppm, pentaethylene hexamine propylene tetramer succinimide as detergent-dispersant in 100 ppm, polymethacrylate as anti-foaming agent-pour point depressant and octyl phosphonate as corrosion inhibitors in 150 ppm concentration and the ethylhexyl ester of fatty acid of karanja oil as a smoke reducer and lubricity enhancer in 5% of base oil. The doping was done at 60° C. with stirring for 2 hours.

EXAMPLE 9

Preparation of Lube Oil from Base Stock

The base stock was blended with additive n-naphthyl 2-phenylamine as a high temperature anti-oxidant in 200 ppm, molybdenum thiophosphoro luryl oleate as EP additive in 200 ppm, dibenzyl diselenide as EP-lubricity additives in 200 ppm, zinc dialkyl dithiophosphate as low temperature antioxidant-lubricity additives in 250 ppm, pentaethylene hexamine propylene tetramer succinimide as detergent-dispersant in 200 ppm, Silicone polymer oil as antifoaming agent-pour point depressant and alkyl 1H benzotriazole as corrosion inhibitors in 150 ppm concentration and the Octyl phosphate as lubricity enhancer in 100 ppm of base oil. The doping was done at 60° C. with stirring for 2 hours.

EXAMPLE 10

CHARACTERIZATION AND EVALUATION OF LUBE OIL: The formulations were analyzed and evaluated as per ASTM or BIS methods such as ASTM D445/BIS-14234, P25/56-K. Viscosity & Viscosity index, ASTM D 92/BIS-P21/69-Flash point, ASTM D1217/BIS-P16-Rel. Density, ASTM D130/BIS-P15-Copper corrosion, ASTM D97/BIS-P10-Pour point, ASTM D874/BIS-P4-Ash sulfated, ASTM D 664/BIS-P1-TAN, ASTM D4377/BIS-P40-Water, IP 280, 306, 307-Oxidation Test, ASTM D3711-Cocking test.

EXAMPLE 11

EVALUATION: The typical values estimated are, viscosity cst at 40° C. was 28, viscosity index was 105, flash point 160° C., pour point (−)38° C., copper corrosion<1, Total acid number 0.001 mgKOH, Foaming test pass, biodegradability 45%, Oxidation stability (RoBOT at 95° C.) 300 minutes, Density 20° C. 0.881, lubricity-friction coefficient0.15μ, wsd 0.44 mm.

The main advantages of the present invention are that the composition of the hydraulic fluid is fairly biodegradable and eco-friendly and provides better or equivalent performance as mineral oil based hydraulic fluids.

We claim:

1. A process for the preparation of composition of a hydraulic fluid, which comprises:

(a) fractionating heavy alkylate fractions of linear alkyl benzene (LAB) or crackers, at a temperature in the range of 300-400° C., under vacuum distillation to obtain desired fractions of alkyl benzene having carbon atom C18 to C22 and viscosity in the range of 20-30 cst at about 40° C., (b) removing the oxidized product from the above alkyl fractions by known methods to obtain a base stock, and (c) mixing 98-99.8 wt % of the above said base stock, at least one anti-oxidant in the range of 0.005-0.05 W %, at least one extreme pressure additive in the range of 0.005-0.05 W %, at least one detergent-dispersant in the range of 0.05-0.15 W %, at least one anti-foaming agent in the range of 0.01 to 1.0 W %, at least one pour point depressant in the range of 0.01 to 1.0 W %, at least one corrosion inhibitor in the range of 0.10-0.03 W %, and at least one lubricity additive in the range of 0.005-0.05 W %, under stirring, at a temperature in the range of 50-90° C. to obtain the desired hydraulic fluid composition.

2. The process of claim 1 wherein the heavy alkyl benzene used is mono, di or poly substituted alkyl aromatics having one benzene aromatic ring and straight or branched paraffinic chains having carbon atoms mainly C18 to C22.

3. The process of claim 1, wherein the heavy alkyl benzene fractions (C18-22) used is obtained from mono and di alkyl benzenes produced during the production of linear alkyl benzene (LAB) in detergent industry, heavy alkyl aromatics produced in catalytic reformer, and naphtha or gas steam cracker liquid product or mixture thereof.

4. The process of claim 1, wherein the anti-oxidant used is selected from the group consisting of 2,4,6-tri-tert-butylphenol, 2,6-di-tert-butyl-4-n-butyl phenol, 2,6-di-t-butyl-4-methylphenol or n-octadecyl 3-(3,5-di-t-butyl-4-hydroxy phenyl)propionate, penta erythrityl tetrakis[3-(3,5-di-t-butyl-4-hydroxyphenyl)propionate], di-n-octadecyl (3,5-di-t-butyl-4-hydroxybenzyl)phosphonate, 2,4,6-tris(3,5-di-t-butyl-4-hydroxybenzyl)mesitylene, tris(3,5-di-t-butyl-4-hydroxybenzyl)isocyanurate or hindered piperidine carboxylic acids, acylated derivatives of 2,6-dihydroxy-9-azabicyclo[3.3.1]nonane or bicyclic hindered amines or diphenylamines or dinaphthylamines, phenylnaphthyl amines, N,N'-diphenylphenylenediamine or p-octyldiphenylamine, p,p-dioctyl diphenylamine, N-phenyl-1-naphthylamine, N-phenyl-2-naphthylamine, N-(p-dodecyl)phenyl-2-naphthylamine, di-1-naphthylamine, di-2naphthylamine, N-alkyl phenothiazines, imino(bisbenzyl), 6-(t-butyl)phenol, 2,6-di-(t-butyl)phenol, 4-methyl-2,6-di-(t-butyl)phenol, 4,4'-methylenebis(−2,6-di-(t-butyl)phenol), Methyl hydroxy hydro cinnamide, phenothiazines derivatives, alkylated 5-amino tetrazole, di-ter.Butyl p-amino phenol and a mixture thereof.

5. The process of claim 1, wherein the extreme pressure additive used is selected from the group consisting of sulfurized neem oil, sulfurized mahua oil, dibenzyl disulphide, suphurized pentadecyl phenol, thiophosphoro luryl oleate, molybdenum salt of thiophosphoro lauryl oleate, zinc dialkyl dithio phosphate, dibenzyl diselenate, selenophosphoro lauryl oleate, selenophosphoro pentadecyl phenol, molybdenum thiophosphoro pentadecyl phenol and a mixture thereof.

6. The process of claim 1, wherein the lubricity additive used is selected from octyl phosphates, methyl hydroxy hydro cinnamide and a mixture thereof.

7. The process of claim 1, wherein the detergent-dispersant used is selected from the group consisting of calcium alkyl benzene sulfonate, sodium alkyl benzene sulfonate, propylene tetramer succinimide of pentaethyllene hexamine, octyl phosphonates and a mixture thereof.

8. The process of claim 1, wherein the anti-foaming agent used is selected from the group consisting of silicone oil, polyvinyl alcohol, polyethers and a mixture thereof.

9. The process of claim 1, wherein the pour point depressant used is selected from the group consisting of diethylhexyl adipate, polymethacrylate, polyvinylacrylate and a mixture thereof.

10. The process of claim 1, wherein the corrosion inhibitor used is selected from the group consisting of octyl 1H benzotriazole, ditertiary butylated 1 H-Benzotriazole, propyl gallate, polyoxyalkylene polyols, octadecyl amines, nonyl phenol ethoxylates, calcium phenolates of hydrogenated pentadecyl phenol, magnesium alkyl benzene sulfonates and a mixture thereof.

11. The process of claim 1, wherein the lubricating oil composition obtained has the following characteristics:

(i) base stock of tailored heavy 98.0-99.8 wt %, alkyl benzene having carbon atom mainly C18 to C22 in the range of (ii) anti-oxidant in the range of 0.006-0.05% by weight (iii) extreme pressure additive 0.005-0.05% by weight, in the range of (iv) detergent-dispersant in the range of 0.05-0.15% by weight, (v) anti-foaming agent in the range of 0.01 to 1.0% by weight, (vi) pour point depressant in the range of 0.01 to 1.0% by weight, (vii) corrosion inhibitor in the range of 0.10-0.03% by weight (viii) lubricity additive in the range of 0.005-0.05% by weight.

* * * * *